US007479600B2

(12) United States Patent
Sikora

(10) Patent No.: US 7,479,600 B2
(45) Date of Patent: Jan. 20, 2009

(54) ELECTRICAL BUS AND METHOD FOR FORMING AN ELECTRICAL BUS

(75) Inventor: Kenneth R. Sikora, Fort Wayne, IN (US)

(73) Assignee: Group Dekko, Inc., Kendallville, TN (US)

( * ) Notice: Subject to any disclaimer, the term of this patent is extended or adjusted under 35 U.S.C. 154(b) by 0 days.

(21) Appl. No.: 11/763,665

(22) Filed: Jun. 15, 2007

(65) Prior Publication Data

US 2008/0006433 A1 Jan. 10, 2008

Related U.S. Application Data

(60) Provisional application No. 60/813,861, filed on Jun. 15, 2006.

(51) Int. Cl.
*H01B 5/00* (2006.01)

(52) U.S. Cl. ..... 174/68.2

(58) Field of Classification Search ..... 174/133 R, 174/133 B, 84 R, 88 R, 88 B, 69, 70 B, 71 R, 174/71 B, 72 R, 72 B
See application file for complete search history.

(56) References Cited

U.S. PATENT DOCUMENTS

| | | | | |
|---|---|---|---|---|
| 2,419,469 | A | 4/1947 | Spiro | 29/155.55 |
| 4,306,511 | A | 12/1981 | Ashby et al. | 113/1 N |
| 4,611,381 | A | 9/1986 | La Barge et al. | 29/432 |
| 4,831,711 | A | 5/1989 | Rapp | 29/509 |
| 4,897,912 | A | 2/1990 | Slasinski | 29/432.2 |
| 5,051,020 | A | 9/1991 | Schleicher | 403/282 |
| 5,517,743 | A | 5/1996 | Liebig et al. | 29/521 |
| 6,294,739 | B1 * | 9/2001 | Becker | 174/126.1 |
| 6,381,122 | B2 * | 4/2002 | Wagener | 361/611 |
| 6,684,479 | B2 | 2/2004 | Wang et al. | 29/521 |

FOREIGN PATENT DOCUMENTS

| | | | |
|---|---|---|---|
| DE | 39 27 045 A | * | 1/1991 |
| DE | 1324427 A1 | * | 7/2003 |

* cited by examiner

*Primary Examiner*—William H Mayo, III
(74) *Attorney, Agent, or Firm*—Taylor & Aust, P.C.

(57) ABSTRACT

An electrical bus forming method including the steps of interlocking a plurality of electrical conductors and forming a shaped conductor. The interlocking step includes interlocking a plurality of electrical conductors including a first electrical conductor with a second electrical conductor thereby forming an interlocked conductor. The forming step includes forming a shaped conductor from the interlocked conductor.

18 Claims, 2 Drawing Sheets

ELECTRICAL BUS AND METHOD FOR FORMING AN ELECTRICAL BUS

CROSS REFERENCE TO RELATED APPLICATIONS

This is a non-provisional application based upon U.S. provisional patent application Ser. No. 60/813,861, entitled "ELECTRICAL LOCKED CONNECTION", filed Jun. 15, 2006.

BACKGROUND OF THE INVENTION

1. Field of the Invention

The present invention relates to electrical conductor assemblies, and, more particularly, to electrical bus bars and a method for making electrical bus bars.

2. Description of the Related Art

Electrical conductors for use in the delivery of power and signals to circuit components are known in the art as bus bars. Bus bars are electrically conductive, and are commonly made of copper. Bars of copper are often shaped by a forming die to cut and to form the copper into a shaped bus bar. Bus bars can include connection points, such as spade connectors made with parts of the bus bar that are cut and shaped to form points of interconnection. The shaping of bus bars to include interconnection points eliminates the need for a terminal or interface lug to be connected to the bus bar for the transfer of power from the bus bar to another circuit component or an additional bus bar.

Bus bars that have interconnections that extend significantly from the main body of the bus bar create problems associated with scrap in the manufacture of the formed bus bar. For example, if a bus bar is being made having a length of 4 feet, and has a main body width of 1 inch the blank needed to form the bus bar will need to be 4 feet long by an inch plus the length of the circuit interconnections that would extend therebeyond for the width. So if one interconnection extends 2 inches from the edge of the finished bus bar in one direction and a ½ inch from the other side of the bus bar then a blank 3½ inches wide must be utilized to cut the 1 inch body with extensions extending two inches on one side and a ½ inch on the other. Whether there are numerous 2 inch extensions or merely one, the blank area required to stamp out the bus bar would remain at 3½ inches, thereby potentially creating considerable waste.

What is needed in the art is a method to produce a bus bar with minimal scrap utilized in the process of forming the final desired shape.

SUMMARY OF THE INVENTION

The present invention provides a method for producing a shaped bus bar from a plurality of interlocked electrical conductors.

The invention in one form is directed to an electrical bus forming method including the steps of interlocking a plurality of electrical conductors and forming a shaped conductor. The interlocking step includes interlocking a plurality of electrical conductors including a first electrical conductor with a second electrical conductor thereby forming an interlocked conductor. The forming step includes forming a shaped conductor from the interlocked conductor.

An advantage of the present invention is that a bus bar assembly can be manufactured with considerably less waste than prior methods.

Another advantage of the present invention is that the attached conductor can be bent without consideration of adding relief cuts to the blank during the cutting operation.

Another advantage of the present invention is that the interlocking features provide more conductivity than the cross-sectional area of the material that is bent to form an interface connector in the prior art.

Yet another advantage of the present invention is that no fasteners or soldering or braising is necessary to connect the conductors in the present invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
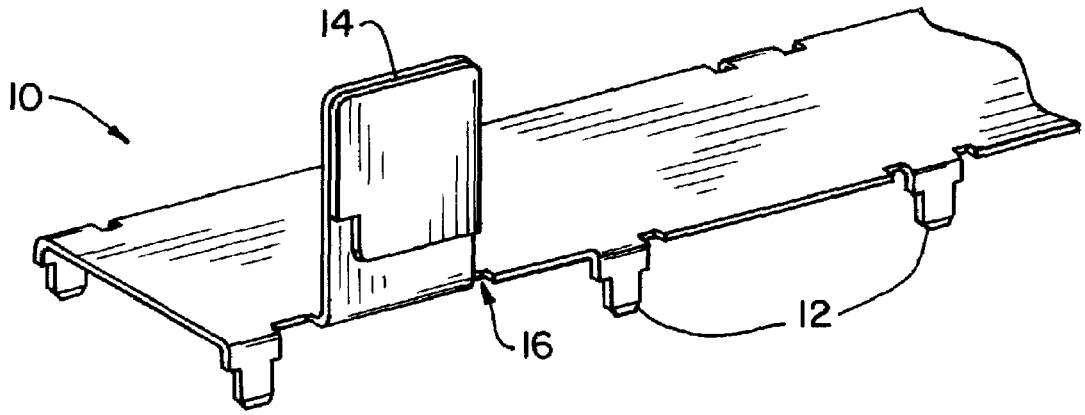
FIG. 1 is a perspective view of a formed electrical bus bar.
Figure 2:
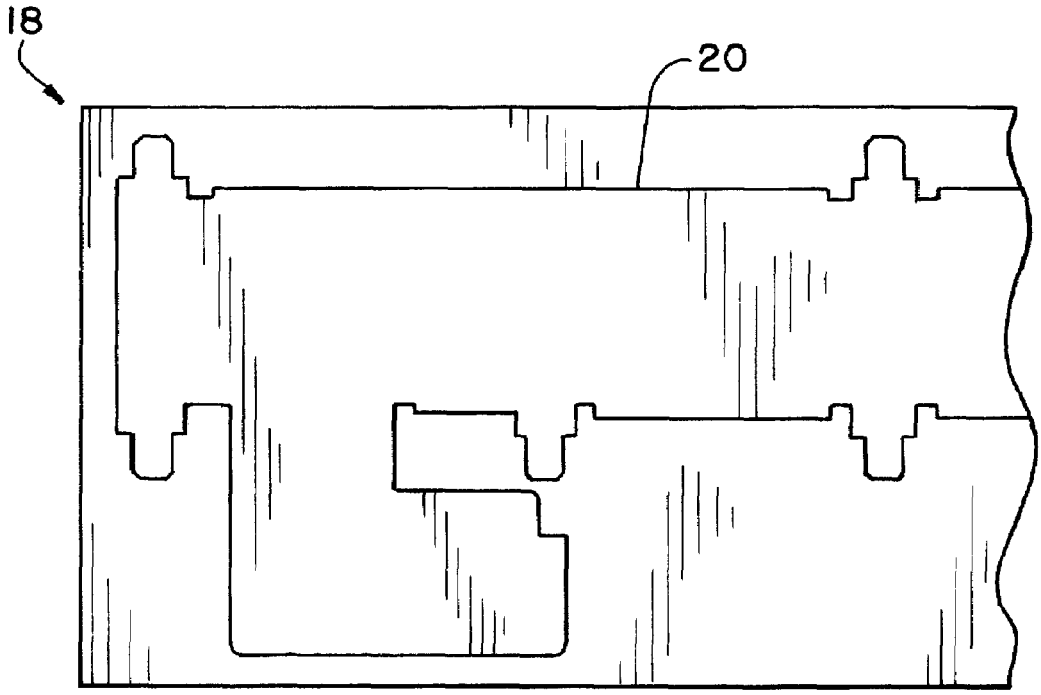
FIG. 2 illustrates a blank of metal used to cut the bus bar of FIG. 1 prior to forming the bus bar of FIG. 1.

Referring now to the drawings, and more particularly to FIGS. 1 and 2, there is shown a formed assembly 10 having electrical spade connectors 12, an interface conductor 14 with a relief slot 16. Formed assembly 10 is made from a blank 18 that is cut along cut lines 20. Blank 18 results in significant amount of waste after the cutting of the unformed assembly from blank 18. The main reason that significant waste exists in this particular instance is that interface conductor 14 extends considerably outward from the main body of the bus bar, thereby requiring a larger blank for the cutting and forming operation to result in formed assembly 10.

Figure 3:
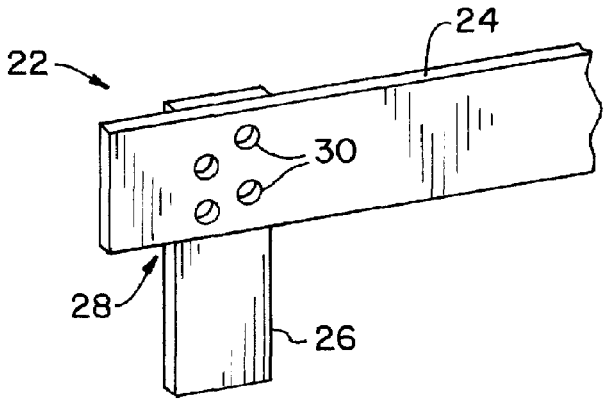
FIG. 3 illustrates the blank prepared for cutting and forming by a method of the present invention.
Figure 4:
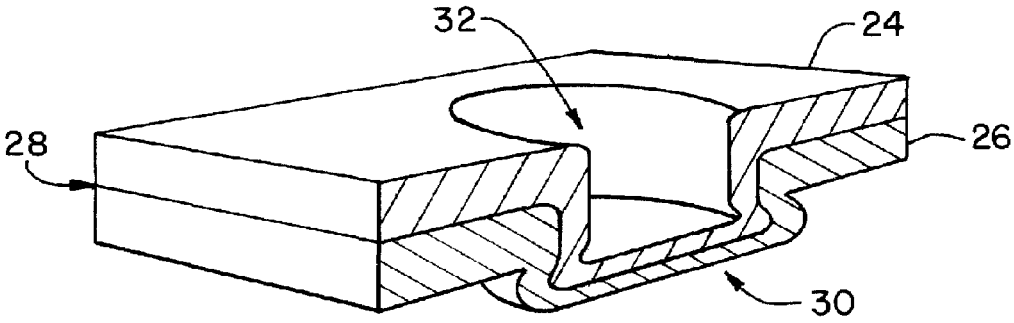
FIG. 4 is a cross-sectioned perspective view of an interconnection feature utilized in the bus bar blank of FIG. 3.
Figure 5:
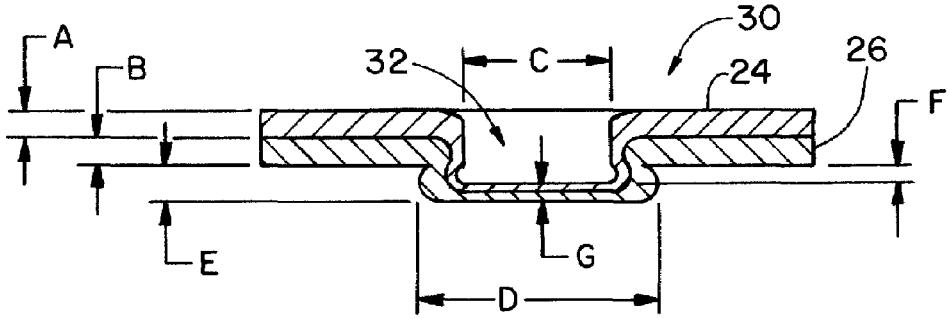
FIG. 5 is a cross-sectional view of the interconnection feature of FIG. 4.

Now, additionally referring to FIGS. 3-5, there is shown an embodiment of the present invention including conductor assembly 22 having a conductor 24 and a conductor 26 that overlap in an overlap area 28. Conductor 24 is joined to conductor 26 by interlocking features 30. Here four interlocking features 30 are utilized to connect conductor 24 to conductor 26. Conductors 24 and 26 are electrically conductive and may be made of aluminum or copper. As can be understood, conductor assembly 22 is then cut and formed into a formed assembly 10. An assembly 10 cut and formed in this manner is made of interlocked conductors having interlocking features 30. While assembly 10 formed in this manner may mechanically vary in overlap area 28 as compared to forming assembly 10 from blank 18, it does not alter the electrical functionality of a formed assembly 10 made from a conductor assembly 22 versus one made from a blank 18. The cutting and/or forming action can be done with a stamping die in either one or two operations. If two operations are undertaken the first is done using a cutting die and the second stamping operation is a forming operation where the bus bar is stamped to bend and/or fold portions of the bus bar.

Conductor 24 has a thickness A and conductor 26 has a thickness B. Indentation 32 has a diameter or width C and is pressed into conductor 24 thereby forming indentation 32 with some of the material of conductor 24 being expanded outwardly at an orthogonal direction relative to the direction of indention 32. As some of the material of conductor 24 is expanded outwardly, along with material of conductor 26, the result is a material connection shown as interlocking features 30. The width of interlocking feature 30 as it relates to conductor 26 is width or diameter D. The forming of interlocking features 30 corresponds to a thinning of material of conductors 24 and 26 to a thickness represented by G. In the forming of indentation 32, an expansion 34 at an end of indentation 32 takes place so that conductor 24 and conductor 26 are locked together. The interlocking features 30, which are illustrated as having been executed four times in overlap area 28, results in a contact between conductor 24 and conductor 26 that is equal to or greater than the cross-sectional area of the bent portion of interface conductor 14 when formed from blank 18. The term "interlocking" as used herein is to be understood to mean and refer to the process of displacing the material of two conductors as described above. The term "interlocked conductor" as used herein is to be understood to mean and refer to two or more conductors having being connected by the interlocking process.

By using conductor assembly 22 to form assembly 10 significant waste is reduced in the process as compared to the use of blank 18 to form assembly 10. Additionally, the interlocking of conductor 24 to conductor 26 prior to the cutting and forming aspects of the operation allow for interface conductor 14 to then be accurately determined. It is the removal of some of the material of conductors 24 and 26 in the cutting process by way of a cutting process that then determines the final outer profile of assembly 10. In contrast, if interface conductor 14 were to be later added to the assembly that has already been formed, the orientation, alignment and positioning of interface conductor 14 cannot be controlled as accurately as having conductors 24 and 26 joined prior to the cutting and forming operations. The removal of some material in the cutting process as applied to conductor assembly 22 is minimal compared to the use of blank 18, where the amount of scrap can exceed the amount of material used in formed assembly 10.

Although conductors 24 and 26 have been illustrated as being of substantially equal thickness, different thicknesses of the conductors is also contemplated. For example, in FIG. 1, interface conductor 14 has been folded to provide a thicker construct, which is the most practical way to provide such a structure from a blank 18. However, using a conductor 26 that is thicker than conductor 24 precludes the need to fold interface conductor 14 to obtain the desired thicker construct. This also allows for no thinning of the cross-sectional area in the bend from interface conductor 14 to the main body.

The inventive method of the present invention and the assembly that results is made with reduced amount of scrap and additionally has superior electrical conductivity due to interlocking features 30. Additionally, the interconnection of conductors 24 and 26 is accomplished without introducing another element, such as solder or a fastener.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical bus forming method, comprising the steps of:

interlocking a plurality of electrical conductors including a first electrical conductor with a second electrical conductor thereby forming an interlocked conductor without soldering or brazing; and forming a shaped conductor from said interlocked conductor.

2. The method of claim 1, wherein said forming step includes a step of stamping said interlocked conductor.

3. The method of claim 2, wherein said stamping step includes a step of removing some material from said interlocked conductor.

4. The method of claim 3, wherein said forming step includes a step of shaping said interlocked conductor by bending at least one portion of said interlocked conductor.

5. The method of claim 4, wherein said forming step includes applying both said removing step and said shaping step to both said first electrical conductor and said second electrical conductor.

6. The method of claim 1, wherein said interlocking step includes a step of displacing portions of both said first electrical conductor and said second electrical conductor in at least two substantially orthogonal directions.

7. The method of claim 6, wherein said first electrical conductor and said second electrical conductor have an area of overlap, said displacing step being applied to said area of overlap.

8. The method of claim 7, wherein said displacing step is carried out on at least two places in said area of overlap.

9. An electrical bus forming method, comprising the steps of:

displacing material in a plurality of electrical conductors including a first electrical conductor with a second electrical conductor thereby forming an interlocked conductor without the use of a fastener or solder; and forming a shaped conductor from said interlocked conductor.

10. The method of claim 9, wherein said forming step includes a step of stamping said interlocked conductor.

11. The method of claim 10, wherein said stamping step includes a step of removing some material from said interlocked conductor.

12. The method of claim 11, wherein said forming step includes a step of shaping said interlocked conductor by bending at least one portion of said interlocked conductor.

13. The method of claim 12, wherein said forming step includes applying both said removing step and said shaping step to both said first electrical conductor and said second electrical conductor.

14. The method of claim 9, wherein said displacing step includes the displacement of portions of both said first electrical conductor and said second electrical conductor in at least two substantially orthogonal directions.

15. The method of claim 14, wherein said first electrical conductor and said second electrical conductor have an area of overlap, said displacing step being applied in a portion of said area of overlap.

16. The method of claim 15, wherein said displacing step is carried out on at least two places in said area of overlap.

17. An electrical conductor assembly, comprising a plurality of electrical conductors including a first electrical conductor and a second electrical conductor, said first electrical conductor having a flat area positioned adjacent a flat portion of said second electrical conductor defining an area of overlap, said first electrical conductor and said second electrical conductor being interlocked to each other in said area of overlap by way of displaced portions of the materials of said first electrical conductor and said second electrical conductor, said plurality of electrical conductors being stamped after said first electrical conductor and said second electrical conductor were interlocked.

18. The electrical conductor assembly of claim 17, wherein the materials ate displaced in at least two substantially orthogonal directions.

* * * * *

UNITED STATES PATENT AND TRADEMARK OFFICE

CERTIFICATE OF CORRECTION

PATENT NO. : 7,479,600 B2
APPLICATION NO. : 11/763665
DATED : December 11, 2008
INVENTOR(S) : Kenneth Sikora It is certified that error appears in the above-identified patent and that said Letters Patent is hereby corrected as shown below:

COLUMN 6

At line 6, please delete "ate"; and substitute therefore --are--.

Signed and Sealed this

Sixteenth Day of March, 2010

David J. Kappos

David J. Kappos
*Director of the United States Patent and Trademark Office*